US005699682A

United States Patent [19]

Durazzani

[11] Patent Number: 5,699,682

[45] Date of Patent: Dec. 23, 1997

[54] WASHING TUB OF A CLOTHES WASHING MACHINE

[75] Inventor: Piero Durazzani, Porcia, Italy

[73] Assignee: Electrolux Zanussi Elettrodomestici S.p.A., Pordenone, Italy

[21] Appl. No.: 628,742

[22] PCT Filed: Nov. 28, 1994

[86] PCT No.: PCT/EP94/03941

§ 371 Date: Apr. 15, 1996

§ 102(e) Date: Apr. 15, 1996

[87] PCT Pub. No.: WO95/17543

PCT Pub. Date: Jun. 29, 1995

[30] Foreign Application Priority Data

Dec. 23, 1993 [IT] Italy ..... PN930036 U

[51] Int. Cl.[6] ..... D06F 37/04; D06F 37/22

[52] U.S. Cl. ..... 68/140

[58] Field of Search ..... 68/140; 34/601; 277/9; 384/537, 540

[56] References Cited

FOREIGN PATENT DOCUMENTS

| | | | |
|---|---|---|---|
| 26018 | 4/1981 | European Pat. Off. . | |
| 43429 | 1/1982 | European Pat. Off. . | |
| 9215811 | 2/1993 | Germany . | |
| 6711687 | 3/1968 | Netherlands | 68/140 |
| 395914 | 1/1966 | Switzerland . | |
| 2086946 | 5/1982 | United Kingdom | 68/140 |

*Primary Examiner*—Philip R. Coe

*Attorney, Agent, or Firm*—Pearne, Gordon, McCoy & Granger LLP

[57] ABSTRACT

Clothes washing machine provided with a washing tub made of plastic material and comprising a rear wall (2), a passing-through hub provided at the center of said rear wall and inserted in its central hub-holding portion (4) for supporting the bearing (7) used to support the central shaft (5) of the drum (6), wherein said hub includes a first perimetral sleeve (8) adapted to be inserted from inside the tub, the outer cylindrical edge thereof being adapted to engage against the inner edge of said cylindrical central hub-holding portion (4), a second sleeve (9) capable of being inserted from outside the tub into the inner cylindrical cavity of said first sleeve, the outer edge thereof being adapted to engage, preferably in a screw-like manner, against the inner edge of said first perimetral sleeve (8). Said first perimetral sleeve is provided with a flange (10) having its projecting rim abutting against the inner wall of the tub, while said second sleeve (9) is provided with a flange (11) having its projecting rim abutting against the outer wall of the tub.

11 Claims, 3 Drawing Sheets

14
11

9
11

11
9

WASHING TUB OF A CLOTHES WASHING MACHINE

The present invention refers to a clothes washing machine, particularly of the household type, provided with an improved type of washing tub made of plastic material.

Although the present invention refers specially to a washing machine of the front-loading type, and for greater convenience of exemplification the following description is actually referred to such a type of washing machine, it can in an advantageous manner be applied also to other types of washing machines, in .particular to the ones that are loaded from the top and have their drum rotating about an horizontal axis.

Plastic washing tubs for clothes washing machines are known to substantially comprise a rigid structure forming the peripheral cylindrical envelope and the rear circular wall, and a front wall having a circular shape, too, which is sometimes separated and is capable of being attached to said rigid structure by means of per se known fastening means.

In correspondence of the rear wall, preferably radial ribs are provided in a usually integral way so as to increase the strength of the tub, said ribs being arranged radially from the central portion of said rear wall, as this is for instance illustrated in the Italian patent application no. PN91U000040.

A through-hole, in which the shaft supporting and rotatably driving the drum housed within the tub is inserted, is provided in correspondence of said central portion of the rear wall, said shaft being shrink-fitted, outside the tub, into a pulley on which a belt is acting to transmit the motion needed to rotatably drive the drum.

To support said shaft and enable it to rotate under the lowest possible friction effect, as well as to ensure an adequate sealing effect against washing liquor leaking therethrough, such a hole is usually provided with a coaxially arranged hub carrying the bearings for the shaft and normally locked against the inside wall of the hole with known locking means, such as for instance by means of screws or through a press-fitting arrangement or again by moulding the plastics of the tub directly over said hub. The latter is further joined to an external flange adhering to the wall of the tub, and in particular to the portions in relief thereof, said flange being fastened to said wall using known fastening means, preferably a plurality of through-bolts or screws.

The provision of such a hub, if on the one hand it is required to ensure both the support of the shaft and a water-tight sealing of the tub, has the drawback that the hub itself is directly exposed to the relatively high temperatures to which the washing liquor is usually heated up, said washing liquor touching directly the central portion of the rear wall of the tub.

This fact, owing to the mechanical action exterted by the rotating shaft against said hub, leads to a gradual stressing of the plastic material which, after a certain period, undergoes an aging process with a decay in its overall mechanical properties that may become visible through such failures as a loss of tightness (water leakage) or the hub becoming loose from its plastic seat.

Such a development is not effectively opposed by the external fastening of the afore cited flange, owing to the slack that gruadually builds up in the holes accomodating said through-bolts or screws.

Furthermore, in the case of a replacement of the bearing or any other repair work to be done under removal of the drum, it is absolutely necessary that said screws or bolts be first loosened and this, if performed repeatedly, leads eventually to a permanent deformation of the plastic material around said fastening elements, so that the need arises to ultimately replace the tub itself. Furthermore, it should be emphasized that the assembly of a great number of fastening screws and/or bolts to the tub turns out to be rather expensive due to both the required processing work and the amount of material used.

It therefore is a purpose of the present invention to provide a washing tub having superior structural and functional characteristics with respect to prior-art tubs, which is capable of ensuring long-term resistance to risks of decay and resulting loosening of the hub, through the application of a particular Jaw-type clamping apparatus as described in the appended claims.

The invention will be more readily understood from the description which is given below by way of non-limiting example with reference to the accompanying drawings, in which.

Figures 4, 4A, 4B:
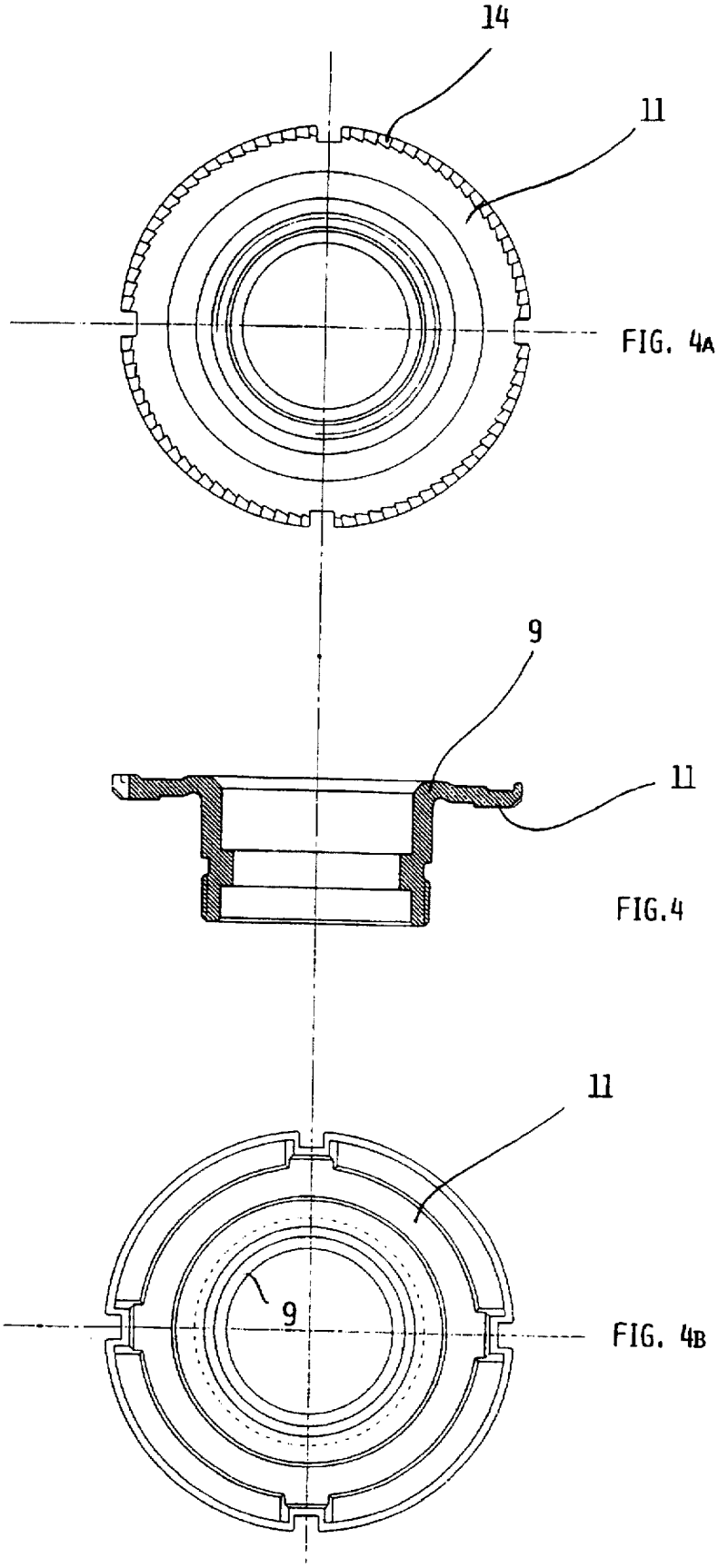
Figure 5A:
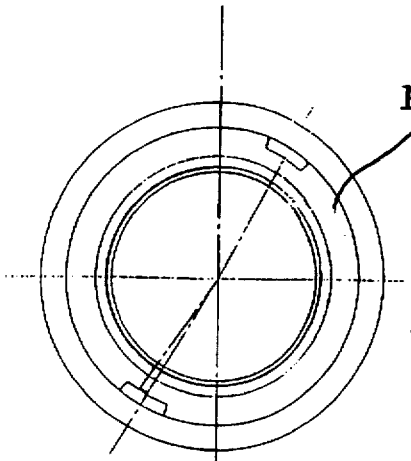
Figure 5:
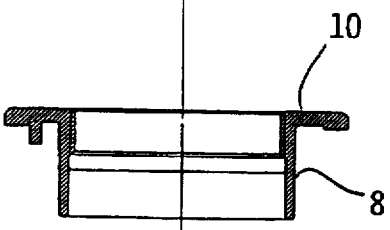
Figure 5B:
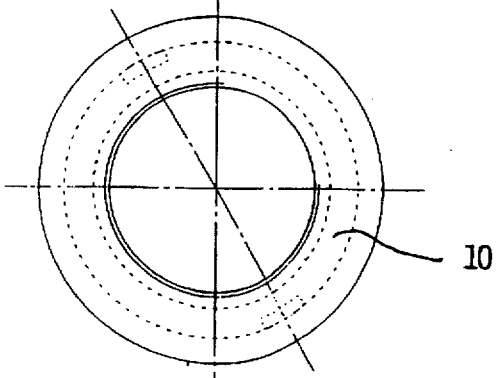
Figure 6:
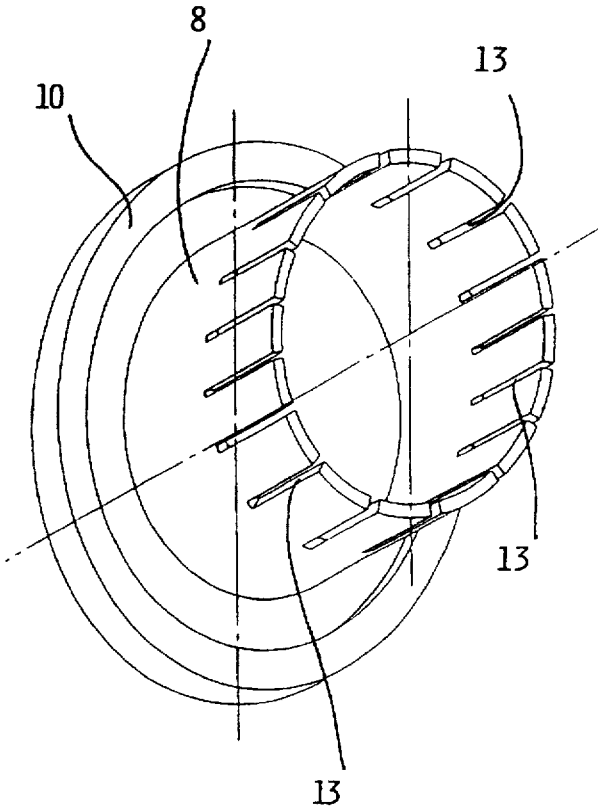

FIGS. 4, 4*a* and 4*b* are a cross-section view and two opposite views from the outside, respectively, of a feature according to the present invention;

FIGS. 5, 5*a* and 5*b* are a cross-section view and two opposite views from the outside, respectively, of a second feature according to the present invention;

FIG. 6 is a view of a variant of the feature shown in FIG. 4.

Figure 2:
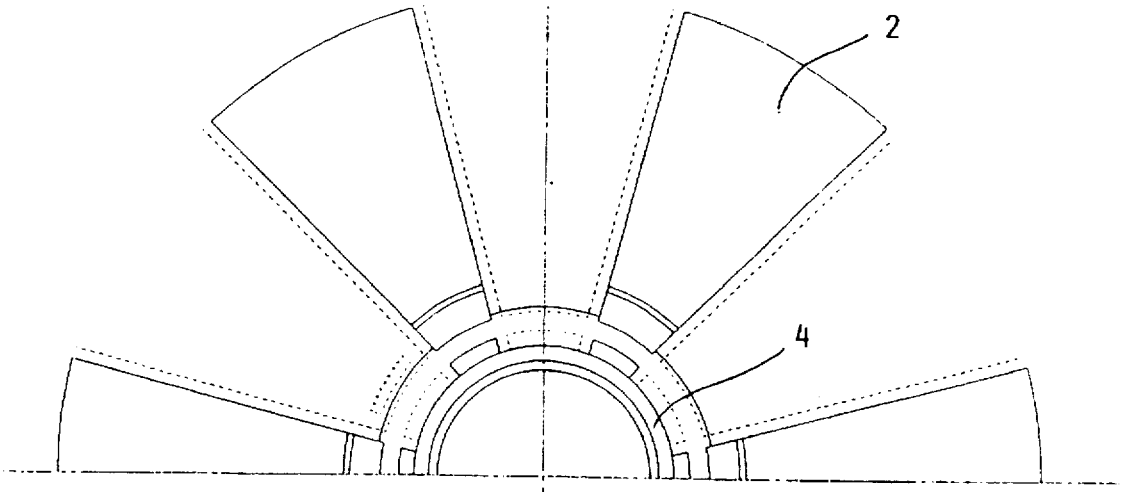
FIG. 2 is a view from the inside of the same area appearing in FIG. 1.
Figure 1:
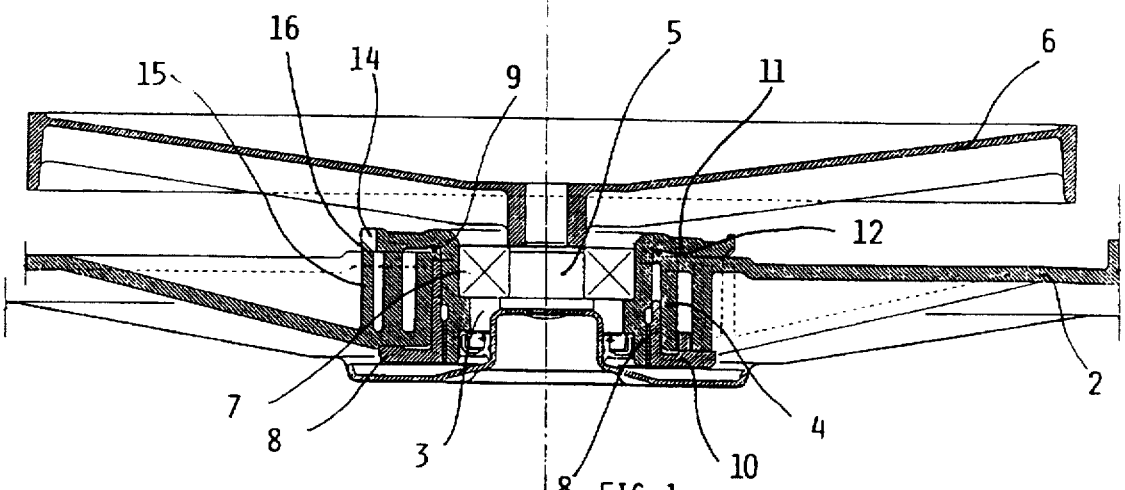
FIG. 1 is a cross-section view of the bearing area of a washing tub according to the present invention.

Referring now to FIGS. 1 and 2, let us look at a washing tub made of plastic material and comprising a rear wall 2 closing a cylindrically shaped peripheral envelope 1. The tub also has a front wall 20 having a circular shape, which is sometimes separated from the cylindrically shaped peripheral envelope 1 and is capable of being attached to the cylindrically shaped peripheral envelope 1. In the central portion 4 of said rear wall 2 there is provided a through-hole in which a hub is housed to support the shaft 5 used to sustain and rotatably drive the drum 6.

Said hub consists of two distinct parts that must be assembled in a pre-established order: first of all, a first perimetral cylindrical sleeve 8 is press-fitted in some appropriate, known manner to get inserted in a firm and water-tight way into said through-hole .provided in said central portion 4; then a second cylindrical sleeve 9 adapted to get inserted into said first sleeve is fitted accordingly, said two sleeves being capable of mutually engage their respective cylindrical matching surfaces, preferably by providing them with a threading so that they can be screwed tightly on.

The second cylindrical sleeve 9 is arranged in a per se known manner so as to be able to house the bearings 7 supporting the shaft 5.

With such an arrangement, disassembling the shaft, and the drum with it, turns actually out to be a most easily and quickly performed operation. In fact, loosening the perimetral sleeve from the peripheral sleeve is all that is needed to obtain the separation of the tub from the drum, while such an operation is easily reversed to also re-assemble said component parts, without this causing any particular stress to be exerted on the involved portion of the plastic wall of the tub.

The present invention enables various improvements to be achieved. First of all, both the first perimetral sleeve (FIG. 4) and the second sleeve arranged inside the first one (FIG. 5) are provided with respective outer flanges 10, 11, of which the flange 10 associated with the peripheral sleeve has its projecting rim abutting against the internal-gear portion of the tub surrounding said central portion 4, while the flange 11 associated with the second sleeve has in a similar way its projecting rim abutting against the geared portion provided on the outside of the tub, so that said flanges are actually facing each other, while being separated from each other by the wall thickness of the tub around said central portion.

With such an arrangement, the advantage is obtained that, when screwing the two sleeves into each other, the respective flanges are tightened from opposite directions against the rear wall of the tub and is fact is instrumental in improving the locking-in of the two sleeves and reducing the strain imposed upon the central portion of said rear wall, since it is involved in its entirety so that it provides a maximum extent of resistance, thereby suffering a minimum extent of deformation, whereas only a small part of such central portion is involved by the strain being applied thereupon in traditional set-ups, said smaller part providing therefore a lower resistance and being as a result subject to a higher degree of deformation.

A further improvement is obtained by providing a ring-shaped sealing gasket 12 in the elbow-type curvature between the second sleeve 9 and the respective external flange 11. As it is shown in FIG. 1, said sealing gasket is compressed between the two sleeves when they are tightened into each other, thereby preventing the wash liquor to seep through between the two sleeves, and does not give rise to any drawback in disassembling since it can be replaced most easily.

In view of enhancing the capability of the perimetral sleeve 8 to expand following the screwing in of the second sleeve 9, so as to be able to get clamped in a still tighter way against the inner cylindrical wall of the through-hole and thereby further improve the solidity and resistance of the coupling between said sleeve and the rear wall, it has been found advantageous to provide said first peripheral sleeve with a plurality of slits 13 running in a parallel arrangement with respect to the axis of the same sleeve and appropriately extending into a portion of the thickness thereof (FIG. 6). In such a manner, said sleeve becomes moderately elastic in a radial direction and therefore enables said two sleeves to be more effectively coupled and clamped against said rear wall.

A further improvement consists in providing a screwing and locking arrangement of said second sleeve 9, whereby the latter can be screwed into said first sleeve in a particularly convenient manner and, once screwed in, it is automatically locked in position.

Figure 3:
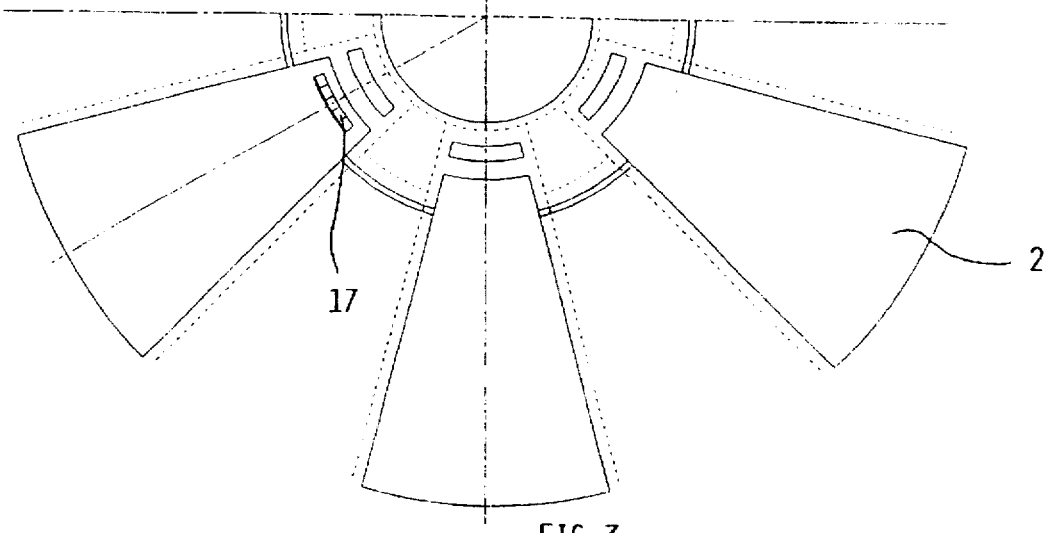
FIG. 3 is a view from the outside of the same area appearing in FIG. 1.

To this purpose, a saw-toothed profile 14 is arranged on the outer edge of the flange 11 of said second sleeve 9, as shown in FIG. 4*a*, and a corresponding appropriate ring-nut portion 15, which is coaxial with said central hub-carrying portion, is joined to said rear wall and is sized and oriented in such a way that its free end 16 (see FIG. 1), which is in turn provided with a plurality of teeth 17 (see FIG. 3), is capable to engage some of the saw-teeth of said profile 14.

The practical advantage of such an improvement is quite apparent. In fact, in order to screw in said second sleeve 9 it will be sufficient to use an appropriate alligator wrench, or the like, which engages the corresponding saw-toothed profile 14 and causes it to rotate. Then, once it is duly screwed in, said sleeve will further be immediately locked in position by the resistance opposed by the teeth 17 to the saw-teeth of the profile 14 of the respective flange 11.

In order to enable said sleeves to be unlocked and disassembled, on the other hand, it will be sufficient that the portion 15 of said ring-nut be just slightly enlarged with an elastic deformation, so as to enable the respective teeth 17 to become released from the saw-toothed profile of the outer edge of the flange 11, then letting it rotate so as to unscrew it from the first sleeve 8.

Although the invention has been described on the basis of the example represented by some preferred embodiments thereof, and using a generally known terminology, it cannot be considered as been limited by these, since anyone skilled in the art will appreciate that a number of variations and modifications can be further made involving both construction and shape. The appended claims shall therefore be understood to include such possible modifications as anyone skilled in the art is capable of appreciating, and which do not depart from the scope and the real meaning if the present invention.

I claim:

1. A domestic clothes washing machine having a washing tub made of plastic material, the washing tub having a cylindrically shaped peripheral envelope, a rear wall (2) defining a cylindrically shaped central portion (4) with an inner rim, a circular front wall, and a passing-through hub arranged at the center of said rear wall and inserted in the central portion (4) of said rear wall, said hub carrying a bearing (7) provided to support a central shaft (5) of a drum (6), characterized in that said hub comprises a first perimetral sleeve (8) having an inner rim, an outer cylindrical rim and an inner cylindrical cavity, which is capable of being inserted from outside the tub and whose outer cylindrical rim engages the inner rim of said cylindrically shaped central portion (4), a second sleeve (9) having an outer rim, which is capable of being inserted from inside the tub into the inner cylindrical cavity of said first sleeve and whose outer rim engages the inner rim of said first perimetral sleeve (8), said second sleeve (9) being adapted to support said bearing (7).

2. The clothes washing machine according to claim 1, wherein the rear wall has an outer wall and an inner wall; said first perimetral sleeve is provided with a flange (10) abutting against the outer wall; said second sleeve (9) is provided with a flange (11) abutting against the inner wall, and the second sleeve and the flange forming an inner curvature; and a ring-shaped sealing gasket means (12) is disposed in the inner curvature.

3. The clothes washing machine according to claim 2, wherein said second sleeve has a threaded outer surface and said first sleeve has a corresponding threaded inner surface, said second sleeve adapted to be inserted into said first sleeve by screw engagement between the corresponding threaded surfaces.

4. The clothes washing machine according to claim 2 or 3, wherein inserting said second sleeve into said first sleeve causes said respective flanges (10, 11) to become clamped against the surrounding central portion (4) of said tub.

5. The clothes washing machine according to claim 4, wherein said first perimetral sleeve is provided with a plurality of slits (13) running in a parallel arrangement with respect to a longitudinal axis of said first perimetral sleeve and extending substantially over the whole longitudinal dimension thereof.

6. The clothes washing machine according to claim 4, wherein a saw-tooth profile (14) is arranged on an outer edge of the flange (11) of said second sleeve (9); a corresponding ring nut portion (15), which is arranged coaxially with said central portion, is provided on said rear wall and said ring nut portion has a free end (16) provided with a plurality of teeth (17), said profile (14) and said ring-nut portion (15) being sized and arranged so that the teeth (17) of said free end (16) automatically and elastically engage some of the saw teeth of said profile (14).

7. The clothes washing machine according to claim 3, wherein said first perimetral sleeve is provided with a plurality of slits (13) running in a parallel arrangement with respect to a longitudinal axis of said first perimetral sleeve and extending substantially over the whole longitudinal dimension thereof.

8. The clothes washing machine according to claim 3, wherein a saw-tooth profile (14) is arranged on an outer edge of the flange (11) of said second sleeve (9); a corresponding ring nut portion (15), which is arranged coaxially with said central portion, is provided on said rear wall and said ring nut portion has a free end (16) provided with a plurality of teeth (17), said profile (14) and said ring-nut portion (15) being sized and arranged so that the teeth (17) of said free end (16) automatically and elastically engage some of the saw teeth of said profile (14).

9. The clothes washing machine according to claim 2, wherein a saw-tooth profile (14) is arranged on an outer edge of the flange (11) of said second sleeve (9); a corresponding ring nut portion (15), which is arranged coaxially with said central portion, is provided on said rear wall and said ring nut portion has a free end (16) provided with a plurality of teeth (17), said profile (14) and said ring-nut portion (15) being sized and arranged so that the teeth (17) of said free end (16) automatically and elastically engage some of the saw teeth of said profile (14).

10. The clothes washing machine according to claim 2, wherein said first perimetral sleeve is provided with a plurality of slits (13) running in a parallel arrangement with respect to a longitudinal axis of said first perimetral sleeve and extending substantially over the whole longitudinal dimension thereof.

11. The clothes washing machine according to claim 1, wherein said first perimetral sleeve is provided with a plurality of slits (13) running in a parallel arrangement with respect to a longitudinal axis of said first perimetral sleeve and extending substantially over the whole longitudinal dimension thereof.

* * * * *